US005796056A

United States Patent [19]

Bredow et al.

[11] Patent Number: 5,796,056

[45] Date of Patent: Aug. 18, 1998

[54] MULTI-STAGE SWITCH

[75] Inventors: Wolfgang Bredow, Birkenfeld; Thomas Burchard, Pforzheim; Thomas Haug, Kieselbronn, all of Germany

[73] Assignee: NBB Nachrichtentechnik GmbH & Co. KG, Olbronn-Durrn, Germany

[21] Appl. No.: 676,288

[22] PCT Filed: Jan. 17, 1995

[86] PCT No.: PCT/DE95/00068

§ 371 Date: Sep. 12, 1996

§ 102(e) Date: Sep. 12, 1996

[87] PCT Pub. No.: WO95/20232

PCT Pub. Date: Jul. 27, 1995

[30] Foreign Application Priority Data

Jan. 19, 1994 [DE] Germany ..... 44 01 314.0

[51] Int. Cl.[6] ..... H01H 9/26

[52] U.S. Cl. ..... 200/5 A; 200/1 B; 200/517

[58] Field of Search ..... 200/1 B, 4, 5 R, 200/5 A, 5 C, 6 R, 6 A, 6 B, 16 R, 16 A, 16 C, 16 D, 18, 402, 405, 406, 408, 512–517, 520, 341, 50, 37; 400/88, 479, 495.1, 472, 490, 491, 491.1, 491.2, 491.3, 495

[56] References Cited

U.S. PATENT DOCUMENTS

| | | | |
|---|---|---|---|
| 3,210,486 | 10/1965 | Holzer | 200/18 |
| 4,096,935 | 6/1978 | Hanataka et al. | 400/479 |
| 4,421,966 | 12/1983 | Pounds | 200/309 |
| 4,609,791 | 9/1986 | Abbat | 200/5 A |
| 5,115,108 | 5/1992 | Ogawa et al. | 200/1 B |
| 5,313,027 | 5/1994 | Inoue et al. | 200/5 A |
| 5,350,890 | 9/1994 | Fairbrother et al. | 200/5 A |
| 5,510,584 | 4/1996 | Norris | 200/5 A |
| 5,559,311 | 9/1996 | Gorbatoff | 200/513 |

FOREIGN PATENT DOCUMENTS

| | | | |
|---|---|---|---|
| 0 344 625 | 12/1989 | European Pat. Off. | H01H 23/02 |
| 0 347 904 | 12/1989 | European Pat. Off. | H01H 35/26 |
| 0 516 544 | 12/1992 | European Pat. Off. | H01H 13/64 |
| 33 00 186 A1 | 11/1983 | Germany | H01H 13/70 |
| 32 28 241 A1 | 2/1984 | Germany | H01H 13/70 |
| 1165459 | 10/1969 | United Kingdom | H01H 3/02 |

OTHER PUBLICATIONS

German Abstract of DE–U–85 29 136 (PREH), 12 Feb. 1987.

*Primary Examiner*—Michael L. Gellner
*Assistant Examiner*—Michael A. Friedhofer
*Attorney, Agent, or Firm*—Loeb & Loeb LLP

[57] ABSTRACT

A multi-stage switch with a common actuating element and at least two switch elements for making contact provides that the switch elements are disposed next to each other above contact elements of a circuit board which they bridge in the closed state. The actuating element for the switch is movably disposed above the switch elements in such a way that the switch elements respond sequentially when the actuating element is depressed. Such a multi-stage switch can be produced cost-effectively with simple structural means, can be universally used, is easy to operate, maintenance free to the greatest extent and operates dependably.

9 Claims, 4 Drawing Sheets

MULTI-STAGE SWITCH

TECHNICAL FIELD

The invention relates to a multi-stage switch with a common actuating element and at least two switch elements for making contact, which when acted upon with increasing force leads to a successive operation of the switch elements, wherein the switch elements are disposed on a circuit board via contact elements of the same height which they bridge in the closed state, with actuating devices which lie perpendicularly in respect to this circuit board, wherein the actuating element is movably disposed above the switch elements in such a way that its actuating area is located between the switch elements, and with a plastic diaphragm cooperating with the actuating element for the transfer of force from an actuating element to the switch elements.

PRIOR ART

A multi-stage switch in accordance with the species is known from DE A 33 00 186 (FIG. 4). The switch elements in the multi-stage switch represented there are contact beads which are held at different heights above their associated contact elements on a plastic diaphragm as the "switch mat", which is embodied cupola-shaped above the respective contact elements and supports the contact beads at different heights on downward pointed protrusions. The operation of this "switch mat" and the contact beads fastened on it is performed by means of a pressure plate 45 which acts on the cupola- or dome-shaped upper sides of the sections of the switch plate. The pressure plate is connected on its top with an actuating element in the form of a key, which is laterally guided in a "cage" 22, so that it is assured that the pressure plate always remains parallel with the circuit board even when operated, tilting is not possible. Thus the function of this switch is based on the height offset of the contact beads on the plastic membrane.

With this known solution the dependable functioning of the multi-stage switch therefore decisively depends on the elaborate shaping of the switch mat, coupled with very long contact travel and a relative tall housing for guiding the pressure plate. This may be without problems in connection with the preferred field of use of the solution in accordance with the known reference (key selection blocks for telephone user stations), but with increasing miniaturization and in other fields of use of such multi-stage switches dependable functioning may no longer be assured, particularly because of the above mentioned elaborate construction of the so-called switch mat. The mentioned difficulties should at least considerably complicate the production of multi-stage switches with more than two switch elements.

An input switch is known from U.S. Pat. No. 4,096,935 (FIGS. 4, 14, 15) in which the one part of the contact of several switches is constituted by a common electrically conducting plate 28 which is upwardly curved in a cupola shape in respect to and above its associated counter-contact. A switching force is brought by means of a common actuating element 44 to these cupola-shaped bumps via a tiltable plate 44 in such a way that these switch-over successively and in this way a contact is closed in succession. This construction is used as an actuating element (forward space key 22), here, too, long contact travel with a considerable tilt angle of the actuating disk are provided, a device for positioning the actuating element 44 on the crowns of the cupola-shaped curved parts of the common conductor element 28 is not provided or cannot be seen. The dependability of these elements is restricted by this.

DE-U-85 29 136 discloses a key switching device in which a tongue-like actuating element 9 is disposed above contacts which are to be closed, which itself can be operated by a switching knob 3 of a rubber-elastic switch mat 2. The successive action on the two contacts is performed here by shaped protrusions of different height of the insert element 9, the insert element in particular is elaborately designed. In a simplified embodiment (FIG. 4), the underside of the switching knob is provided with switch surface elements 23, 24 which are offset in height, so that with a perpendicular operation of this switching knob the switch contact shown at the left side in FIG. 4 is operated by the one on the right, provided that this force application takes place perpendicularly from above and not laterally. In its basic concept the functional principle of this simplified exemplary embodiment approximately corresponds to the solution in accordance with the species and is therefore based on dependably maintaining the once provided height difference of the actuation surfaces and actuating contacts during the switching movement, a requirement which can only partially be met.

EP A 0 516 544 shows a switch such as is used in the automotive field, for example. A tiltable or pivotable actuating element 11 again is an important component, which acts on a plate 25 with several switch contacts. In this case the first switching stage is attained by pivoting the actuating elements 11, the second switching stage by a lateral displacement, which requires a special construction of the switch elements 23 and an elaborate mechanism of the entire switch.

EP A 0 347 904 shows a multi-pressure switch in which a diaphragm is employed as the exterior actuating element, which acts via pins 42 and 44 on a support plate 22, which then can actuate three contacts by means of successive tilting. Long contact travel, a tall structural dimension and a mechanically elaborate construction also characterize this embodiment.

EP A 0 344 625 shows a mechanically simpler solution, wherein an operating rocker 5 held on a stationary seated shaft 16 is provided which is intended to sequentially operate two groups of catch springs on a circuit board 3 by means of a rigid and a length-adjustable plunger. Although the stationary seating of the switch rocker leads to stability of this arrangement, it requires additional, mechanically elaborate steps in the form of the length-adjustable switch plunger.

DE A 32 28 241 shows a multi-switch wherein it is intended to simultaneously operate two or three switch contacts by means of a common actuating unit, for which purpose a particular "pressure distributor" is provided which is intended to assure the simultaneous (parallel) actuation of the switch contacts. Successive switching is not provided and not possible with this key mechanism.

Finally, GB A 1 165 459 shows a switch unit in which a plurality of mechanical switches is successively displaced with the aid of an actuating plate 14 similar to a wobble plate, wherein the contact travel of the actuating element (button 13) must at least correspond to the contact travel of the switches 3, 4. The dependability of operation of this device decisively depends on how precisely the mechanical pre-stress of the individual pressure switches can be set, which must be provided with elaborate additional mechanisms for this purpose (FIG. 2).

All of the solutions discussed above have the decisive disadvantage that they require a very great (mostly mechanical) effort for creating a dependable switching operation, along with a plurality of specially shaped components, awkward construction and therefore a limited field of use, as well as high costs caused by this.

REPRESENTATION OF THE INVENTION

It is therefore the object of the invention to produce such a multi-stage switch with minimal structural effort and therefore cost-effectively and simply, by means of which it is also possible to switch three or more switch elements in electrical or electronic devices, and which can be universally used, is easy to operate, maintenance-free to a great extent and operates dependably.

This object is attained in in a manner which will be described below.

The basic concept of the invention consists on the one hand in the use of a (basically known per se) switch rocker as an actuating element, with the possibility of a variable relative height positioning of the switch elements during the switching process.

In this case the switching characteristics of the individual switch elements is independent of the movement behavior of the actuating element (in contrast to the subject of the device in accordance with the species) and can therefore be very simply and dependably adjusted by an appropriate selection ("hard" or "soft"), by means of which a dependable definition of the switching time is possible even with several switch elements, namely at exactly the time when the triggering force of the respective switch element has been reached or exceeded by the component of the switching force acting on this switch element. The other component of the attainment of the object in accordance with the invention consists in exactly defining and limiting the contact travel, for which the switching conduits are provided. It is possible by means of this simplified principle and the omission of elaborate actuating structures, such as the known switch mat, for example, to realize solutions without difficulties and by using simply manufactured components, wherein three or more switch elements are intended to be dependably successively switched.

Advantageous embodiments of the attainment of the object in accordance with the invention can be taken from the dependent claims.

BRIEF DESCRIPTION OF THE DRAWINGS

Exemplary embodiments of the multi-stage switch in accordance with the invention will now be explained in detail by means of the drawings. Shown are in.

DESCRIPTION OF THE EXEMPLARY EMBODIMENTS

Figure 1A:
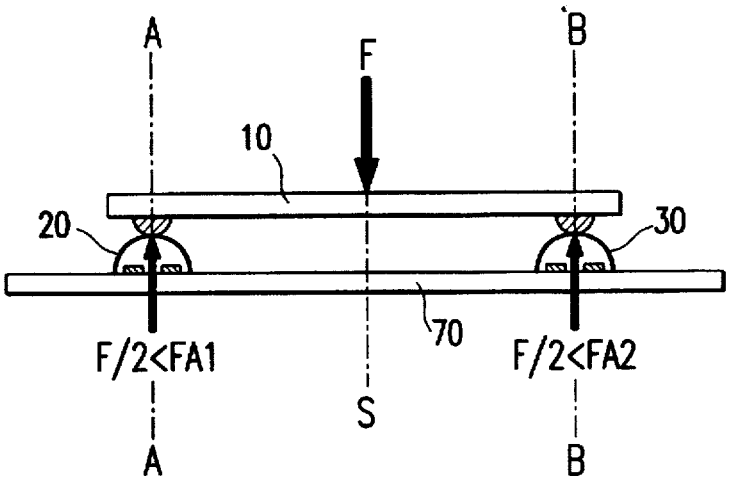
FIGS. 1A, 1B and 1C are simplified pictorial elevational views representing the principle of the invention.
Figure 1B:
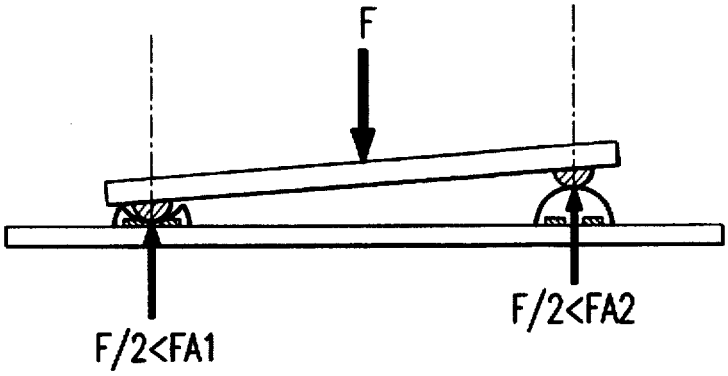
Figure 1C:
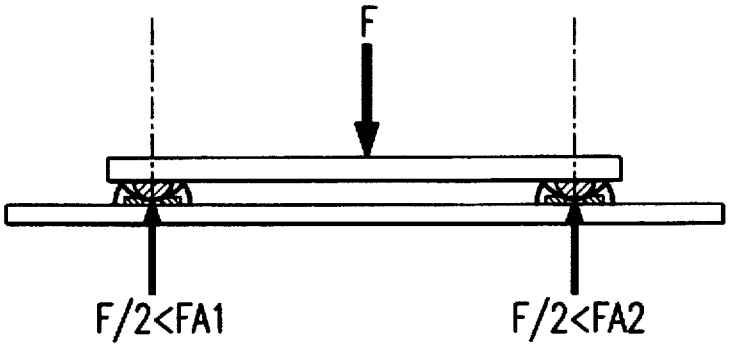

FIGS. 1A, 1B and 1C show, respectively, the three switching states of a multi-stage switch formed of two switch elements 20 and 30 wherein the principles of the invention are applied. The two switch elements 20, 30 are located on a circuit board 70, for example the printed circuit board with printed circuits, which are to be connected with each other at the intended switch points. The switch elements 20, 30 are preferably embodied as disk springs ("click frogs"). The two switch elements 20, 30 are switched by triggering forces acting perpendicularly in respect to the circuit board 70, therefore the actuation directions A or B of the two switch elements 20 or 30 extend through these switching elements and perpendicularly in respect to the circuit board 70.

Both switch elements 20, 30 are bridged by an actuating element 10, on which the actuating force F acts from the outside. To this extent it is possible to call this actuating element 10 a "switch rocker".

The contact travel direction S, caused by the effect of the switching force F, also extends perpendicularly in respect to the circuit board 70.

It is decisive that the contact travel direction S lies between the actuating directions A or B of the two switch elements 20, 30. In the represented example of the principle, the exterior conditions are preset in such a way that the contact travel direction S lies in the center between the actuating directions A, B, so that therefore the switching force F is divided into two equal components F/2, which respectively act on the two switch elements 20, 30.

In the initial state represented in FIG. 1A, the switching force F is still relatively slight, so that the two components F/2 which act on the switch elements 20, 30, lie below the triggering force FA1 of the switch element 20 as well as below the triggering force FA2 of the switch 30. Accordingly, the switching force F is not sufficient to perform the first switching process.

If the switching force F is increased (FIG. 1B), a state is finally reached wherein the component F/2 acting on the switch element 20 is equal to or greater than the triggering force FA1 of the switch 20. The result of this is that the switch element 20 is depressed, i.e. the switch is actuated and contact between the contact elements on the circuit board 70 is made. Since the component F/2 of the switching force F which acts on the other switch element 30 is still below the triggering force FA2 defined there, it is not yet sufficient to actuate this switch. Therefore FIG. 1B characterizes the first stage.

If the switching force F is further increased (FIG. 1C), its component F/2 acting on the switch 30 finally also reaches the triggering force FA2 of this switching element 30, so that now a contact is made by means of this switch element. Therefore FIG. 1C shows the second stage of the switching process.

In the example of the principle shown, the successive switch-through of the switch elements 20, 30 is therefore accomplished by means of a different switch or response characteristic of these two switch elements, with the switching force component F/2 being the same. It can be directly seen that the same effect can also be achieved by, for example, a displacement of the switching direction S of the actuating force F in the direction towards one of the switch elements 20, 30; in such a case it would also be possible to utilize switch elements of the same switching characteristics, since the different switching time would then be defined by the differing values of the force components acting on the individual switch elements.

Figure 2:
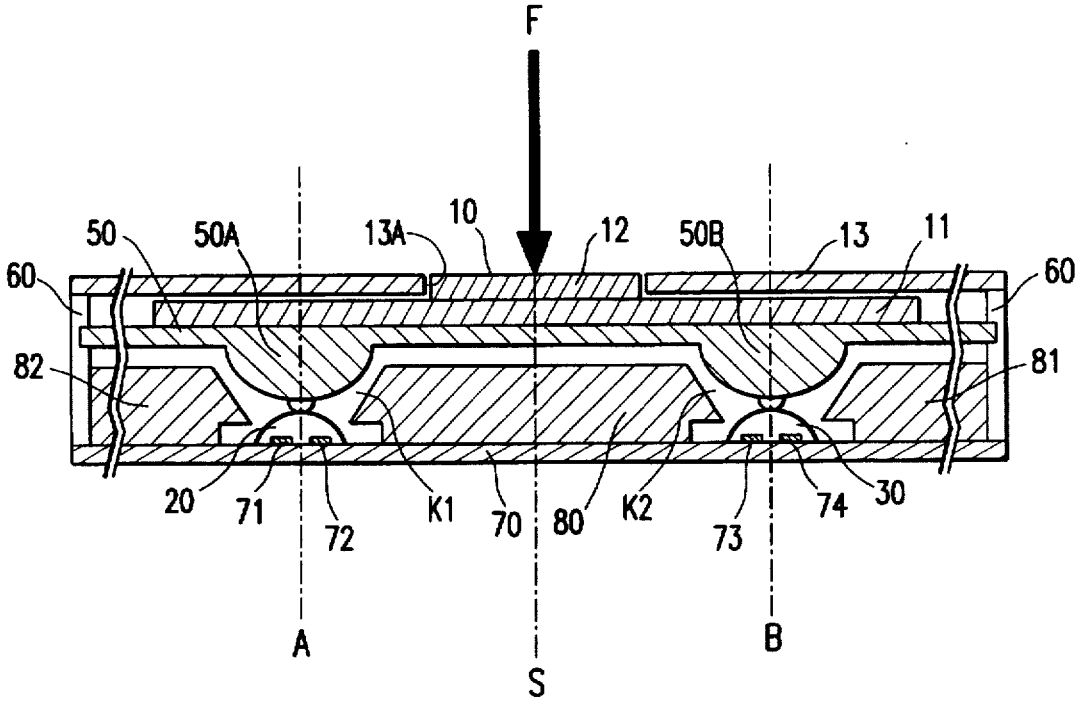
FIG. 2: longitudinal sectional view of a first exemplary embodiment.

FIG. 2 shows a first exemplary embodiment of a multi-stage switch functioning in accordance with the principle represented in FIGS. 1, wherein therefore the successive switching-through of the switch elements is realized by means of their different response characteristics, so that in what follows only the structural design of this exemplary embodiment will be explained:

The actuating element 10 is constituted by a pressure plate 11, in whose center area (in the area of the switching direction S) an attachment 12 has been placed which projects outward through an opening 13A of a stationary cover 13 and represents the operating surface for the user of the multi-stage switch. In connection with this it is necessary to assure that the width of the attachment 12 has been matched to the solidly inserted switch elements 20, 30 (for example disk springs) so that even in case of a force acting at the edge of the attachment 12 and the subsequent change in the force components acting on the two switch elements the chronological sequence of the two switching processes remains assured.

The stationary cover 13 as a rule is the housing cover of the respective electrical device in which the two-stage switching process is to be performed.

A plastic diaphragm 50 is attached to the underside of the pressure plate 11, which is used both for guiding the pressure plate 11 and as a restoring element, and which is held by its edges in the sidewall of the housing 60 of the electrical device for this purpose (to this extent the representation in FIG. 2 is not true to scale).

Hemisphere-like protrusion 50A, 50B have been formed out of the underside of the plastic diaphragm 50, whose undersides are then used to act on the switch elements 20, 30. Several distancing elements ("spacers") 80, 81, 82 are located between the plastic diaphragm 50 and the circuit board 70 which, on the one side, limit the contact travel of the pressure plate 11 downwardly, on the other side define switching conduits K1, K2, which are used for the secure guidance of the protrusions 50A, 50B of the plastic diaphragm from the rest position to the switching position. These switching conduits are in particular embodied to be downwardly tapering (in the shape of a truncated cone), so that assured centering and precise determination of the switching time is made easier.

In the switched-through state the two contact elements 71, 72, for example strip conductors on the printed circuit 70 embodied as a printed circuit plate, are bridged in this way, and thereafter the contact elements 73, 74 by means of the other switch element 30.

Figure 3:
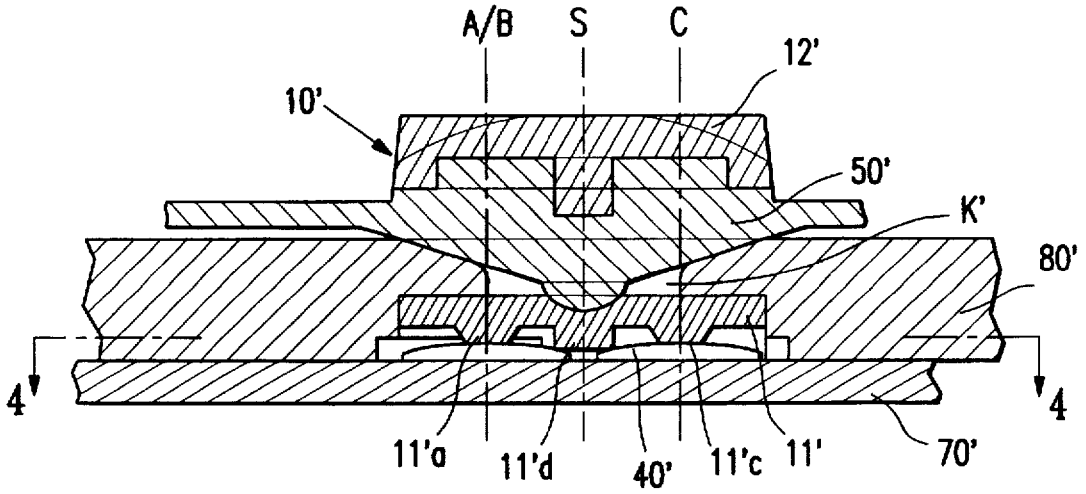
FIG. 3: longitudinal sectional view of a second exemplary embodiment.
Figure 4:
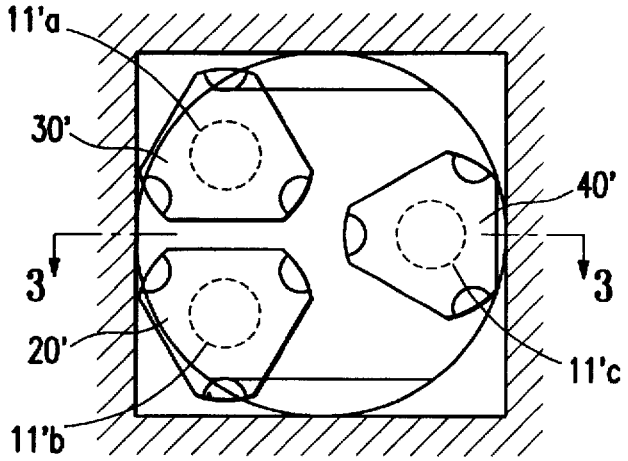
FIG. 4: a section along the plane 4—4 in FIG. 3, FIG. 5: longitudinal sectional view of the expanded second exemplary embodiment, and FIG. 6 a section along the plane 6—6 in FIG. 5.

FIGS. 3 and 4 show a second exemplary embodiment of a multi-stage switch which also functions in accordance with the principle represented in FIGS. 1A, 1B and 1C, wherein however the successive switching-through of the switch elements is generated by an appropriate shaping of the underside of the pressure plate in such a way that several "deeply extending" protrusions are provided which sequentially act on the switch elements.

Three switch elements are disposed next to each other in the second exemplary embodiment (FIG. 4), which are covered by the common pressure plate 11'. The switch elements 20', 30', 40' are also located on a common circuit board 70', the same as in the above explained first exemplary embodiment. The pressure plate 11 is also actuated by means of an attachment 12' which acts on the center (axis S) of the pressure plate 11' via a diaphragm 50', which is also used as a restoring element. Thus, in the second exemplary embodiment shown the pressure plate 11' and the diaphragm 50' are reversed in the height sequence of their positions in contrast to the first exemplary embodiment. A spacer 80' is located between the diaphragm 50' and the circuit board 70', into which a cylindrical guide for the pressure plate 11' as well as a cone-like guide for the diaphragm 50' have been cut coaxially to each other. On its underside the pressure plate 11' has three protrusions 11'*a*, 11'*b*, 11'*c* in the shape of truncated cones which are centrally located above the switch elements 20', 30' 40'. In the exemplary embodiment shown, the switch elements 20', 30', 40' are metal snap disks with a hysteresis switching behavior (also called "click frogs"). In the course of actuating these switch elements, the contact elements (not shown) located under them are bridged as in the first embodiment and in this way an electrical connection is made. By means of a mutual matching of the "depths" of the protrusions 11'*a* . . . 11'*c* and/or the responsiveness of the switch elements 20' . . . 40' it is possible to achieve that the pressure plate 11' guided in the cylindrical recess of the spacer 80' actuates the three switch elements sequentially when the multi-switch is actuated, wherein here, too, the pressure plate 11' acts as a "switching rocker" to the extent that a successive pivoting around two pivot axes which are inclined toward each other takes place.

In its central area (in the axis S) the pressure plate 11' has a downward pointing cylindrical pin 11'*d* which defines the maximum downward deflection of the pressure plate 11', to this extent the circuit board 70' is used here as a "stop" for this pin 11'*d*. It is self-explanatory that the effect of this stop can only take place after the two tilting movements around the two pivot axes and the successive actuation of the contact elements have taken place.

Figure 5:
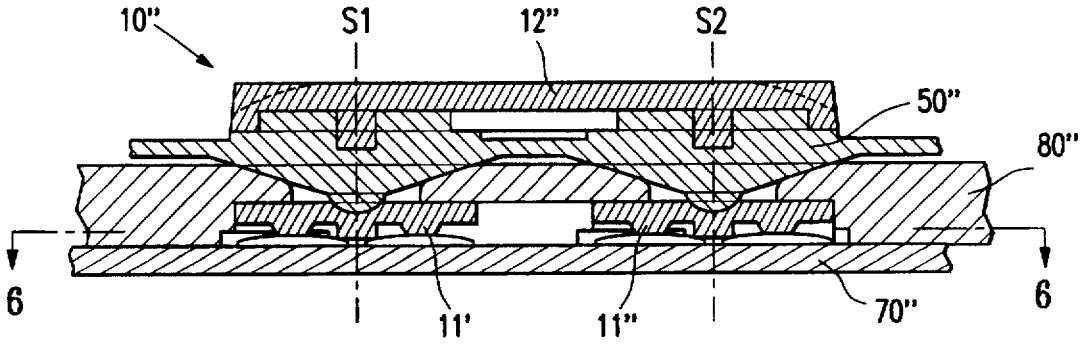
Figure 6:
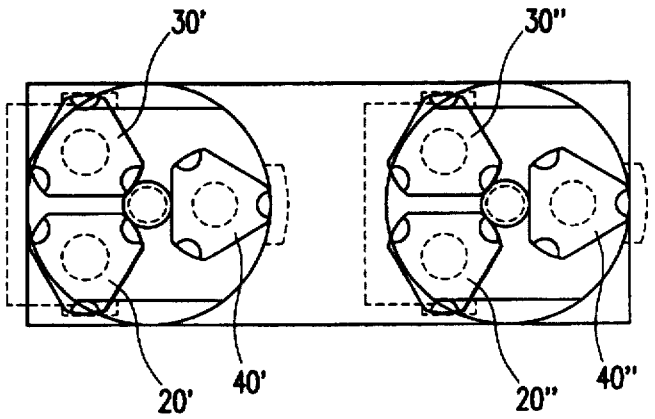

In the second exemplary embodiment represented in FIGS. 5 and 6 two multi-stage switches in accordance with FIGS. 3 and 4 are arranged next to each other and are actuated by means of a common attachment 12" and a common plastic diaphragm 50". In this case six switch elements 20', 30', 40', 20", 30", 40" are provided which are actuated by means of two pressure plates 11', 11" and which switch through or bridge the contact elements located below them. Accordingly, two actuation areas S1, S2 exist, which can be alternatively selected (for example by means of an appropriate graphic indication on the top of the attachment 12).

We claim:

1. A multi-stage switch comprising:

a circuit board carrying at least two pairs of contact elements, said pairs of contact elements being spaced from one another;

at least two switch elements disposed on said circuit board, each of said switch elements being operatively associated with a respective pair of said contact elements and being movable into a closed state for bridging said contact elements of said respective pair;

a common actuating element operatively associated with said switch elements, said common actuating element having an actuating area which is located between said switch elements, and said common actuating element being movable in response to an increasing force applied to said actuating area to move said switching elements successively into the closed state;

a plastic diaphragm located above said common actuating element and having a central protrusion via which said diaphragm transmits the increasing force to said actuating area of said common actuating element; and a spacer disposed on said circuit board and having a conduit which extends to said actuating area and in which said central protrusion of said plastic diaphragm is guided, wherein:

said switch elements and said common actuating element cooperate to cause said common actuating element to pivot about an axis which is essentially parallel to said circuit board in response to the increasing force to move said switching elements successively into the closed state.

2. The multi-stage switch in accordance with claim 1 wherein said conduit in said spacer has a cross section which tapers in a direction from said plastic diaphragm to said circuit board.

3. The multi-stage switch in accordance with claim 2 wherein said conduit in said spacer has a frustoconic form.

4. The multi-stage switch in accordance with claim 1 where said contract elements are strip conductors.

5. The multi-stage switch in accordance with claim 1 wherein each of said switch elements is a disk spring.

6. The multi-stage switch in accordance with claim 1 wherein each of said switch elements is a metal snap disk.

7. The multi-stage switch in accordance with claim 1 wherein said common actuating element is guided in said spacer.

8. The multi-stage switch in accordance with claim 1 wherein said common actuating element carries a plurality of actuating protrusions which project toward said circuit board, each of said protrusions being located to engage a respective one of said switch elements.

9. The multi-stage switch in accordance with claim 1 wherein said switch elements are constructed such that each of said switch elements is moved into the closed state by a force having a respectively different value for each of said switch elements.

* * * * *